United States Patent [19]

Johnson et al.

[11] 4,397,701

[45] Aug. 9, 1983

[54] METHOD OF MAKING MASKS

[75] Inventors: Sander K. Johnson, Topanga; Tim Murphy, Canoga Park; Dean Hensley, Los angeles; Ronald Sallon, Agoura, all of Calif.

[73] Assignee: International Mask Research Foundation, Santa Monica, Calif.

[21] Appl. No.: 236,529

[22] Filed: Feb. 20, 1981

[51] Int. Cl.[3] ..... B32B 31/22; B32B 33/00

[52] U.S. Cl. ..... 156/62; 2/206; 46/157; 156/247; 156/344; 206/225; 206/575; 264/222; 264/258; 264/DIG. 30; 428/247; 428/703; 434/82

[58] Field of Search ..... 2/206; 46/151, 156, 46/157; 128/156; 156/59, 62, 247, 344; 206/225, 575; 264/222, 258, DIG. 30; 428/247, 703; 434/82

[56] References Cited

U.S. PATENT DOCUMENTS 3,537,930 11/1970 Anderson ..... 434/82 X
4,294,634 10/1981 Mookil ..... 156/59

OTHER PUBLICATIONS

"Leading Print Media to Feature Amsco's Pariscraft Sculpture Set", Playthings, Oct. 1963, p. 84.

*Primary Examiner*—Robert A. Dawson
*Attorney, Agent, or Firm*—Jacobs & Jacobs

[57] ABSTRACT

A method of making a mask which comprises molding a sculptable material, affixing the said molded material to a facial form to the desired contours of the mask, which contours are different than the contours of the form, applying wetted strips of plaster-impregnated gauze to the molded material, drying the wetted gauze to form a completed mask and removing the form from the mask. The finished mask may be coated with a coat of white glue and decorated.

15 Claims, 4 Drawing Figures

METHOD OF MAKING MASKS

This invention relates to a method of making a mask, especially suitable for use by children and young adults, and kits in which the required materials are arranged together in a ready-to-use form, and more particularly to the use of a pre-molded facial form, moldable material, such as metal foil, and plaster impregnated gauze.

The use of ritual and theatrical face masks dates back to prerecorded history. Styles, meanings and approaches to ritual mask use interconnect the seemingly diverse ancient cultures of Africa, Asia, Europe, North and South America and of countless isolated islands. In other societies theatrical masks have developed into highly refined art forms as seen in the Japanese Noh theatre, Balinese dance drama, Pacific Northwest Indian ceremonials, comedia dell'arte of the Italian Renaissance, the mystery and morality plays of the Dark Ages, the comedy and tragedy masks of the classical Greek theatre and in contemporary cinema and television.

Viewed from a cultural perspective, the entire range of masks made by people throughout history encompasses the full spectrum of human expression. Masks have been purposefully made to look symbolic, ornate, strange, crude, complex, scarey, ugly, beautiful and plain. All are equally valid within their context as expressions of individual, traditional or universal ideas. Because of their interdisciplinary approach, mask making can be adapted very simply to respond to the classroom. Essentially it offers a boundless cross-cultural theme which becomes understood in an interdisciplinary way by involving the creative processes of each child.

Heretofore, in the making of masks, a piece of wood was carved with chisel and mallet or papier mache was employed over such diverse forms as balloons, wire structures, or the like. Wood carving requires special skill. The use of papier mache is difficult, especially for children, and requires the use of messy paste. Because of the use of make-shift forms, the level of skill in the use of papier mache is necessarily quite high.

Accordingly, it is an object of the present invention to provide a new and improved method of making a mask requiring no special skills and one that may be easily mastered by children.

A further object of the present invention is to provide a kit containing the essential materials used in this new method of making a mask.

Yet another object of the present invention is to provide a method of making a mask employing a re-usable molded facial form, moldable material such as metal foil, preferably aluminum foil, means for affixing layers of the moldable material, and quick-setting pliable material such as plaster-gauze, which when hardened will provide a durable mask which may then be decorated.

Various further and more specific purposes, features and advantages will clearly appear from the detailed description given below taken in connection with the accompanying drawing which forms a part of the specification and illustrates merely by way of example a preferred embodiment of the invention.

In the following description, and in the claims, parts will be identified by specific names for convenience, but such names are intended to be generic in their application to similar parts as the art will permit.

Like reference characters denote like parts in the several figures of the drawing, in which.

Figure 1:
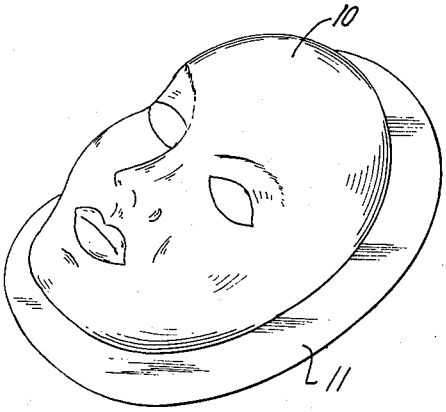
FIG. 1 is a perspective view of a facial form according to the invention.

Referring in more detail to the drawing illustrating a preferred embodiment by which the invention may be realized, there is shown in FIG. 1, a re-useable facial form indicated by the reference number 10.

Facial form 10 consists of a three-dimensional model of a human face, preferably made of vacuum-molded plastic such as high-impact styrene, which has a surrounding flat border, 11, which supports the facial form while resting on a flat surface.

Figure 2:
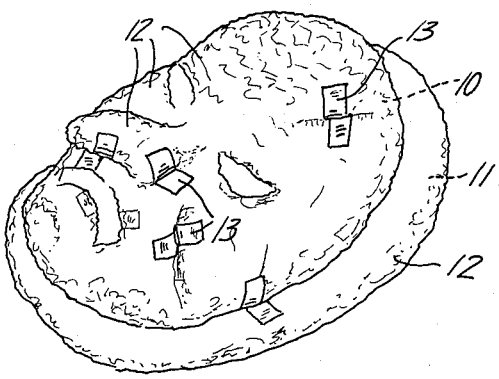
FIG. 2 is a perspective view of a facial form covered with aluminum foil according to the invention.

The creation of a mask using the embodiment depicted in FIG. 1 may be described as follows:

The facial form, 10, is placed on a flat surface, and preferably completely covered with aluminum foil 12 or such other material which will retain its molded shape, yet not adhere to plaster impregnated gauze, in order to facilitate removal of the finished mask. As shown in FIG. 2, the aluminum foil 12 is pressed close to the features on the facial form 10 so that the human facial proportions are clearly visible while sculpting the mask. Additional aluminum foil is molded into desired shapes and affixed to the mask by means of masking tape 13 or other suitable fixatives. Any desired shape may be applied, including projections such as horns, large nose, etc. It is understood that the additional molded foil may be applied directly to the form without the need of the first layer of foil 12.

Figure 3:
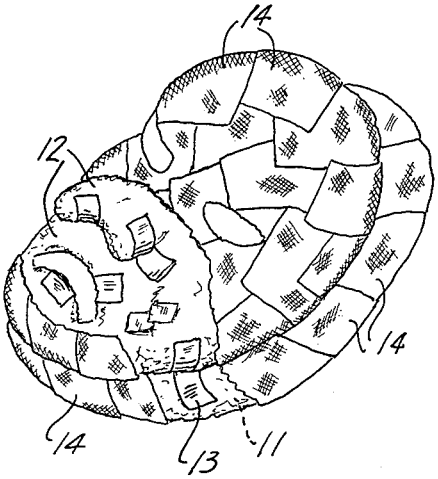
FIG. 3 is a perspective view of a facial form covered with aluminum foil, partially covered with plaster gauze according to the invention.

When the desired shape has been achieved, plaster impregnated gauze 14 is applied to the sculpted surface, as shown in FIG. 3. This material is similar to that employed by physicians and hospitals to make casts for broken limbs. However, it is desirable that the material be made of non-toxic, fire-proof ingredients. This material is especially preferable for use by children because it is non-toxic, strong, fast-setting, and fire-proof.

The plaster impregnated gauze 14 is cut into various size strips, which are individually dipped in water, then applied directly to the sculpted aluminum foil surface 12. This material can be applied flat, or folded to achieve a more durable, finished edge for such areas as eye sockets, mouth, and the surrounding border 11 of the mask. Fine details can be added to the surface by bunching, twisting or otherwise manipulating the plaster impregnated gauze before or during application. Although one coat of gauze may be sufficient, two coats are preferable. The final surface can be rubbed smooth before drying.

Figure 4:
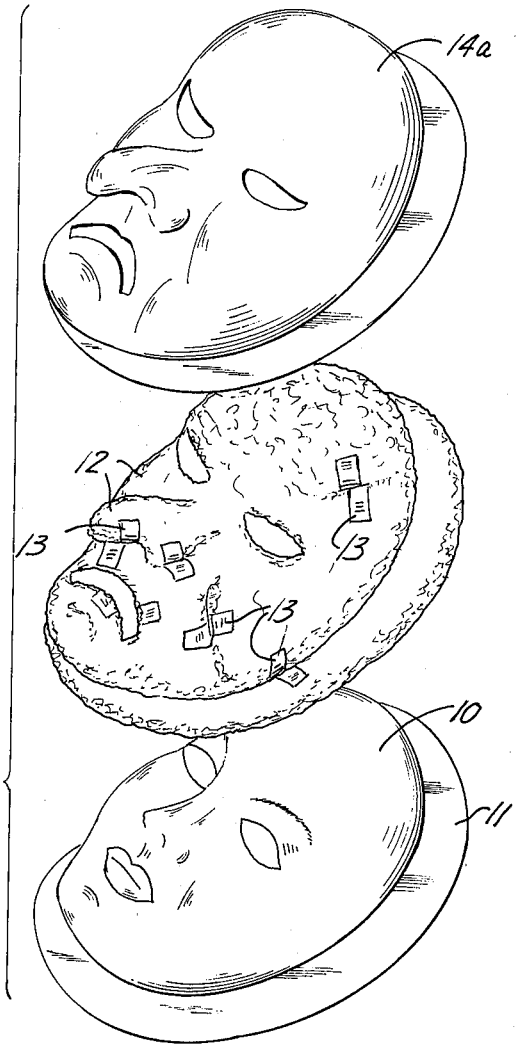
FIG. 4 is an exploded perspective view of the completed sculpted mask removed from the aluminum foil and facial form, according to the invention.

As shown in FIG. 4, when the mask **14*a* is thoroughly dry, the re-useable facial form 10 can easily be removed from the protective aluminum foil 12. After removal of the facial form 10, the aluminum foil 12 can then, in turn, be removed from the inner surface of the mask 14*a*** by gently separating it from the edges of the mask, gathering into a ball in center, and pulling free. Aluminum foil which may have been molded into projections such as horns or nose may be left in place for extra support. This removal may take place before or after painting. If done before painting, there is an opportunity to repair any defects in construction.

The hardened plaster mask 14*a* can be painted with tempera, acrylic, watercolor, or fluorescent-color paints. Conventional white glue, which dries transparent, can be mixed with the tempera or fluorescent-color paints to add luster and protect the surface of the mask. Alternatively, a coat of undiluted white glue may be applied to inner and outer surfaces of painted masks for added strength and to protect the paint and surface of the mask.

After painting and removal from the facial form, the mask can be decorated with other materials, such as yarn, beads, leather or the like, applied with glue or other fixative.

The completed mask can then be adapted for wear or display by attachment of an elastic strap or other material to the sides of the mask. Additionally, the interior may be padded for more comfortable extensive use.

While the invention has been described and illustrated with respect to a certain preferred example which gives satisfactory results, it will be understood by those skilled in the art after understanding the principle of the invention, that various other changes and modifications may be made without departing from the spirit and scope of the invention.

We claim:

1. Method of making a mask which comprises molding a sculptable material, affixing said molded material on a facial form to the desired contours of said mask which are different than the contours of said form, applying wetted strips of plaster-impregnated gauze to said molded material, drying said wetted gauze to form a completed mask, and removing the said form from said mask.

2. Method of making a mask according to claim 1, wherein the said form is first covered with a pliable material that assumes the facial features of said form, whereby said form is protected from said plaster-impregnated gauze, affixing said molded material to said pliable material, and removing substantially all of said pliable material from said mask after said mask is completed and after said form is removed by separating said pliable material from the edges of said mask, gathering said pliable material into a ball in the center of said mask and pulling said pliable material free.

3. Method of making a mask according to claim 1, wherein said sculptable material is metal foil.

4. Method of making a mask according to claim 2, wherein said sculptable material and said pliable material are metal foil.

5. Method of making a mask according to claim 3, wherein said completed mask is removed from said form and said pliable material.

6. Method of making a mask according to claim 4, wherein said completed mask is painted.

7. Method of making a mask according to claim 4, wherein said completed mask is coated with a coat of white glue.

8. Method of making a mask according to claim 5, wherein said completed mask is coated with a coat of white glue.

9. Method of making a mask according to claim 4, wherein said completed mask is coated with a mixture of white glue and paint.

10. Method of making a mask according to claim 5, wherein decorating materials are applied to said painted mask.

11. Method of making a mask according to claim 7, wherein decorating materials are applied to said painted mask.

12. Method of making a mask according to claim 8, wherein decorating materials are applied to said painted mask.

13. Method of making a mask according to claim 4, wherein the inside of said completed mask is padded and means are affixed to said completed mask for holding the mask on the head of a person.

14. Method of making a mask according to claim 5, wherein the inside of said completed mask is padded and means are affixed to said completed mask for holding the mask on the head of a person.

15. Method of making a mask according to claim 9, wherein the inside of said decorated mask is padded and means are affixed to said decorated mask for holding the mask on the head of a person.

* * * * *